US010772451B2

(12) United States Patent
Vernal Silva et al.

(10) Patent No.: US 10,772,451 B2
(45) Date of Patent: Sep. 15, 2020

(54) RECEIVING AND PICK-UP DEVICE FOR POSTAL ITEMS AND CORRESPONDING METHOD

(71) Applicants: Jaime Antonio Vernal Silva, Cologne (DE); Pablo Javier Vernal Munoz, Cologne (DE); Felipe Andres Vernal Munoz, Cologne (DE)

(72) Inventors: Jaime Antonio Vernal Silva, Cologne (DE); Pablo Javier Vernal Munoz, Cologne (DE); Felipe Andres Vernal Munoz, Cologne (DE)

( * ) Notice: Subject to any disclaimer, the term of this patent is extended or adjusted under 35 U.S.C. 154(b) by 0 days.

(21) Appl. No.: 16/320,389

(22) PCT Filed: Jul. 26, 2017

(86) PCT No.: PCT/EP2017/068940
§ 371 (c)(1),
(2) Date: Jan. 24, 2019

(87) PCT Pub. No.: WO2018/019913
PCT Pub. Date: Feb. 1, 2018

(65) Prior Publication Data

US 2019/0261802 A1 Aug. 29, 2019

(30) Foreign Application Priority Data

Jul. 26, 2016 (DE) ..... 10 2016 113 778

(51) Int. Cl.
*A47G 29/20* (2006.01)
*A47G 29/14* (2006.01)

(52) U.S. Cl.
CPC ..... *A47G 29/20* (2013.01); *A47G 29/14* (2013.01); *A47G 29/141* (2013.01);
(Continued)

(58) Field of Classification Search
CPC ..... A47G 29/20; A47G 29/14; A47G 29/141; A47G 29/16; A47G 2029/145;
(Continued)

(56) References Cited

U.S. PATENT DOCUMENTS 476,139 A * 5/1892 Faw ..... A47G 29/12 232/19
1,494,181 A * 5/1924 Morris ..... A47G 29/1216 248/128
(Continued)

FOREIGN PATENT DOCUMENTS

CN 101004316 A 7/2007
CN 203066785 U 7/2013
(Continued)

OTHER PUBLICATIONS

International Search Report for PCT/EP2017/068940, dated Oct. 24, 2017.

*Primary Examiner* — William L Miller
(74) *Attorney, Agent, or Firm* — Sughrue Mion, PLLC

(57) ABSTRACT

A receiving and pick-up device for postal items (2) having a housing (7) comprising a receiving chamber (8) and comprising a base part (9) and an extension part (11), which is arranged adjustably relative to the base part (9) along an adjustment axis (X), wherein a closable exterior opening (16) is formed on a first front face (15) of the base part (9) and a closable interior opening (18) is formed on a second front face (17) of the extension part (11) being opposite the first front face (15) in the direction of the adjustment axis (X), and having an adjustment device (29), which is designed for adjustment of the volume of the receiving chamber (8) such that the extension part (11) can be adjusted along the adjustment axis (X) between a first position, in which the receiving chamber (8) has a first volume, and a second position, in which the receiving chamber (8) has a
(Continued)

second volume enlarged relative to the first volume, and having a deposit band (23) delimiting a floor side of the receiving chamber (8).

16 Claims, 6 Drawing Sheets

(52) U.S. Cl.
CPC .. *A47G 2029/145* (2013.01); *A47G 2029/147* (2013.01); *A47G 2029/149* (2013.01); *A47G 2200/226* (2013.01)

(58) Field of Classification Search
CPC ..... A47G 2029/147; A47G 2029/148; A47G 2029/149; A47G 2200/226; B65D 21/086; B65D 21/068; B65D 7/24; E05B 65/0075
USPC ..... 232/1 E, 17, 19, 38, 45, 43.4; 220/6, 8, 220/476; 70/63
See application file for complete search history.

(56) References Cited

U.S. PATENT DOCUMENTS 1,512,307 A * 10/1924 Pratt ..... A47G 29/12 232/19
1,579,520 A * 4/1926 Fleming ..... A47G 29/12 232/19
1,819,790 A * 8/1931 Redrup ..... A47G 29/122 232/19
1,992,640 A * 2/1935 Steen ..... A47G 29/1209 232/17
2,229,646 A * 1/1941 Firestone ..... A47G 29/1223 220/6
2,750,105 A * 6/1956 Wixom ..... A47G 29/12 232/19
2,781,964 A * 2/1957 Ledgerwood ..... A47G 29/1209 232/17
3,294,216 A 12/1966 Girardi
6,426,699 B1 * 7/2002 Porter ..... A47F 10/00 221/2
6,959,858 B2 * 11/2005 Stagnaro ..... A47G 29/12 232/19
10,299,617 B1 * 5/2019 Castellanos ..... A47G 29/141
10,537,196 B1 * 1/2020 MacPherson ..... A47G 29/141
2003/0006275 A1 * 1/2003 Gray ..... A47G 29/14 232/19
2013/0098980 A1 * 4/2013 Supulski ..... A47G 29/1209 232/38
2016/0331171 A1 * 11/2016 Jiang ..... G06Q 10/0833
2018/0228310 A1 * 8/2018 Enobakhare ..... A47G 29/1207
2019/0180544 A1 * 6/2019 Newcomb ..... G07C 9/00896

FOREIGN PATENT DOCUMENTS

CN 103538660 A 1/2014
CN 105046836 A 11/2015
CN 105672850 A 6/2016
DE 1 187 186 B 2/1965
DE 10 2014 013 367 A1 4/2015
FR 2 618 107 A1 1/1989
JP 08-100580 A 4/1996
JP 09-117366 A 5/1997
JP 2009-030388 A 2/2009
KR 20-2009-0009969 U 10/2009
WO 85/01495 A1 4/1985

* cited by examiner

RECEIVING AND PICK-UP DEVICE FOR POSTAL ITEMS AND CORRESPONDING METHOD

CROSS REFERENCE TO RELATED APPLICATIONS

This Application is a National Stage of International Application No. PCT/EP2017/068940 filed Jul. 26, 2017, claiming priority based on Germany Patent Application No. 102016113778.2 filed Jul. 26, 2016.

BACKGROUND OF THE INVENTION

Field of the Invention

The invention concerns a receiving and pick-up device for postal items, for example for large-volume postal items such as packages, parcels, having a housing comprising a receiving chamber and comprising a base part and an extension part, which is arranged adjustably relative to the base part, along an adjustment device, which is designed for adjustment of the volume of the receiving chamber such that the extension part can be adjusted along the adjustment axis between a first position, in which the receiving chamber has a first volume, and a second position, in which the receiving chamber has a second volume, which is enlarged relative to the first volume. Furthermore, the invention concerns a method for receiving postal items and a method for collecting postal items.

Background

DE 10 2014 013 367 A1 discloses a delivery container for the receipt of parcels and goods in the absence of the recipient. The delivery container has a multi-part housing with a front box and a rear box, which are connected to each other by telescopic rails. By adjusting the front box relative to the rear box, the volume of the receiving chamber enclosed by the housing can be changed. The front box has a lockable door through which a parcel can be placed into the receiving chamber. Furthermore, the delivery container has a suspension for hanging it on a door leaf of an apartment door.

JP 2009/030388 A discloses a foldable delivery container that allows a parcel to be received when the recipient is absent. The delivery container is inserted in a door opening and has a delivery opening with a flap on the corridor side or the outside. When unfolded, a removal flap is accessible, which forms the lid of the delivery container and via which a package inserted into the receiving chamber can be removed. If no parcel delivery is expected, the housing can be folded together.

JP 09117366 A discloses a delivery box for packets. The delivery box has a cylindrical housing with an exterior door and an interior flap. To insert the packet into the delivery box, the packet is pressed against the freely openable and lockable exterior door, thereby pulling out small cylindrical bodies to enlarge the housing to accommodate the packet.

SUMMARY OF THE INVENTION

The purpose of this invention is to provide a device for receiving and picking up postal items which is adapted to the needs of a detached house or multiple-family dwelling or apartement building, has a compact assembly space and allows the reception of various postal items one after the other in the absence of the recipient. Furthermore, it is the purpose of the present invention to provide a method adapted to the needs of a detached house, a multiple-family house, or an apartment building, which can be used flexibly and is available for receiving further postal items in the absence of the recipient after receipt or collection of a postal item.

This task is solved with a receiving and pick-up device as described above having a closable first opening formed on a first front face of the base part and having a closable second opening formed on a second front face of the extension part being opposite the first front face in the direction of the adjustment axis. For example, the first opening is an exterior opening and the second opening an interior opening, whereby a reverse arrangement could also be possible. The arrangement of the two openings opposed to eachother has the following advantages. When receiving a postal item, the postal item can be placed into the receiving chamber through the open exterior opening. This can be done by a human person, for example, whereby the insertion or removal of the postal item can also be carried out by a controlled machine, for example an unmanned aerial vehicle. The adjustment device adjusts the volume of the receiving chamber to the size of the postal item, preferably before opening the exterior opening. Then, first, the exterior opening can be closed and, then, the interior opening can be opened. The extension part is then moved back into the first position with the interior opening being open. The backward movement of the extension part reduces the volume of the receiving chamber and the inserted postal item falls out of the housing through the open interior opening, for example into the corridor of an apartment. Then, the interior door can be closed again so that the receiving and pick-up device is ready to receive further postal items.

Due to the multi-part design of the housing, the housing can be extended or shortened by moving the extension part along the adjustment axis, thus increasing or decreasing the volume of the receiving chamber. In this way, the volume of the receiving chamber can be flexibly adapted to the size of the postal item to be received or picked-up. In the first position, the receiving chamber may have a minimum volume, which may be referred to as the first volume. Then, in said retracted first position the receiving and pick-up device occupies only a small assembly space. However, in a second position, the volume of the receiving chamber can have a maximum size. Anyhow, the second position can also be an intermediate position which does not necessary has to correspond with the maximum attainable volume of the receiving chamber. For example, the receiving chamber can be adjusted stepless from the first position to the second position via a large plurality of intermediate positions by actuating the adjustment device. For example, the exterior opening, the interior opening and the adjustment device can be operated manually. For example, the exterior opening and/or the interior opening can open and close independently. For example, the adjustment device can provide for an automatic or self-acting adjustment of the volume of the receiving chamber by automatic adjustment of the extension part in relation to the base part.

In accordance with one aspect of the invention, a deposit band is provided which delimits the floor side of the receiving chamber. Thus, the postal item can be placed onto the deposit band by the deliverer or sender when it is placed into the receiving chamber. The deposit band assures flexible adjustment of the length of the floor of the receiving chamber, i.e. the longitudinal extension along the adjustment axis, to the longitudinally adjustable housing. The deposit band can have a finit length, i.e. a defined length. The adjustment device can have a rotatably mounted winding drum, whereby a first end of the deposit band is connected to the winding drum so that it can be rolled up and a second end of the deposit band is fixed to a holder, for example by firmly clamping the second end of the deposit band in the holder. Thus, the length of the bottom of the housing can be easily adjusted by winding and unwinding the deposit band. Depending on which component is held stationary, either the winding drum can be moved in the direction of the holder or the holder can be moved into the direction of the winding drum to reduce the length of the bottom of the housing when the deposit band is wound onto the winding drum.

For example, the winding drum can be held stationary relative to the base part and the holder can be arranged on the extension part, so that the distance between the winding drum and the holder can be reduced by winding up the deposit band onto the winding drum. In this way, during winding on the winding drum, the deposit band pulls the extension part in the direction to the base part and, thus, towards the first position. Thus, the volume of the receiving chamber can be reduced by winding up the deposit band. For example, the winding drum can be attached directly to the base part, or to a stationary component on or in which the base part is attached or inserted. This provides a stable support for the rotary drive winding drum and, for example, also for the drive motor. Furthermore, the winding drum can be rotated by a drive motor, for example an electric motor, for example a roller shutter motor. The drive motor can be controlled by a programmable controller in order to allow for automatic adaptation of the receiving and pick-up device to the size of the postal item.

The base part of the housing can be used, for example, in a passage opening in the outer wall of an apartment or house, a door or a window. For this purpose, the base part can have a mounting frame. The mounting frame can be screwed to the wall, glued to the window or the like. The exterior opening may abrade flush with the passage opening or the installation frame inserted into the passage opening. Alternatively, the receiving and pick-up device can also be arranged in a free-standing mail and parcel box or a stand-alone housing. For example, the postal item fallen out of the interior opening can be deposited or dropped into a collection container arranged within the mail and parcel box, from which the postal item can later be removed by the recipient. Furthermore, the receiving and pick-up device can be arranged on an elevated position, e.g. on a roof top of a building. This makes the reception and pick-up device easily accessible for unmanned aerial vehicles, for example. A downpipe, shaft, lift or the like can be connected to the receiving and pick-up device, via which the postal item is passed in the building to the recipient.

In order to enable adjustment of the extension part into the second position, the adjustment device may have an actuator of variable length acting along the axis of adjustment. The adjustment device can be an automatic acting adjustment device, for example. A first longitudinal end of the actuator can be held stationary relative to the base part and a second longitudinal end of the actuator can be supported on the extension part. Thus, the volume of the receiving chamber can be increased by actuating the actuator. As the second end of the deposit band is held fixed, the actuator pulls the deposit band when moving the extension part to the second position, whereby the deposit band is unwound from the winding drum. The actuator can be moved in both directions so that the actuator can also move the extension part back to the first position to offload the deposit band during winding or to offload the drive motor of the winding drum.

For example, the housing is box-like. The base part and the extension part each may have at least two opposite outer walls and each may have a ceiling. In other words, the base part and/or the extension part can each form a U-shaped housing part. The housing is thus protected against unauthorised access from the outside, so that the inserted postal item can only be inserted or removed via the exterior opening or the interior opening. On the bottom or floor side, the receiving chamber can be bounded or delimited by the deposit band. As an alternative to the design with the deposit band, each housing part, for example the base part and the extension part and, if possibly present, intermediate parts, can have their own bottom connected to the respective outer walls. The bottom can also be connected to several housing parts. The base part and the extension part can interlock eachother such that the housing can be enlarged or extended and reduced telescopically along the adjustment axis.

For example, the housing has at least one intermediate part arranged between the base part and the extension part. In this way, the maximum volume of the recording space provided by the receiving and pick-up device can be increased. Then, the at least one intermediate part can be adjusted relative to the base part by the adjustment device along the adjustment axis, analogous to the way of adjustment of the extension part.

For example, an end stop cooperating with the inserted postal item is arranged transversely to the adjustment axis or transversely to the deposit band within the receiving chamber. The end stop can be rigidly mounted or can be held non-rotationally or rotatably on the housing. When inserting the postal item, the postal item can be placed on the bottom of the housing, for example on the deposit band, behind the end stop, as viewed from the exterior opening. When the end stop is held stationary to the base part, it is ensured that the postal item inserted into the receiving chamber is not moved beyond the end stop in the direction of the exterior opening during movement of the extension part back into the first position. In this way, when the extension part is moved into the first position, the postal item can fall out of the interior opening as the interior opening is moved into the direction of the exterior opening. For example, the rotatably held end stop can be L-shaped and connected to the deposit band in a friction-lock so that the end stop is turned into an erected or upright position when the positioning belt is wound. The end stop thus provides a large stop surface on which the inserted postal item can be supported when winding up the deposit band. The long L-leg of the end stop can be in an upright position when the deposit band is winded. Said L-leg of the end stop can, however, fold back onto the deposit band when the housing is extended while the deposit band unwinds from the winding drum. Then, the shorter L-web is furned into an upright position, which simplifies the insertion or removal of the postal item. For example, a well-functioning cooperation of the end stop with the deposit band is achieved by at least one small wheel, for example a plastic wheel, being fastened in the connecting region between the L-leg and the L-web of the end stop, for example non-rotatably fastening the at least one small wheel to the L-leg and/or L-web. The at least one wheel rolls on the deposit band for a short term at least until the end stop is positional upright or folded back onto the deposit band.

In order to avoid sagging of the deposit band, the receiving and pick-up device may have a deposit band reinforcement. For this purpose, at least two movably interconnected reinforcing elements can be arranged below the deposit band, which are folded or superposed in the first position of the extension part and pulled apart in the second position of the extension part. Furthermore, supports may be provided and designed such that the housing can be supported on a stationary ground. In this way, the housing is sufficiently stable even when extended, especially in the second position. The supports can support the housing, for example, against a corridor floor of an apartment. For example, the receiving and pick-up device may be located as close as possible to the stationary ground so that the supports may be as small as possible. The advantage of this arrangement being close to the ground is that the delivered postal item is not damaged when falling out onto the ground, when the extension piece is returned to the first position.

According to one aspect of the present invention, it is intended that the exterior opening and/or the interior opening is/are closable each by a roller shutter. The roller shutters can be easily opened and closed automatically by a roller shutter motor, for example. As an alternative to the roller shutter, at least one of the two openings may be equipped with a laterally hinged door leaf or a flap hinged bottom-side or wall-side or the like. The exterior and/or interior opening may be closed by a flap which is held pivotable about a pivot axis. For example, at least one flap may be held on the housing of the receiving and pick-up device or on a part of the building. The pivot axis can be arranged horizontally, when the device is installed. For example, the at least one flap opens downwards so that, when open, the respective flap forms a deposit surface outside the receiving chamber onto which the postal item can be placed. The deliverer can place the postal item onto said deposit surface, for example by using an unmanned aerial vehicle. In addition, a recetable may be provided on said flap which closes the exterior opening. The receptable can be arranged on an inner side of the flap facing towards the receiving chamber. In this way, the bottom of the receptable defines the deposit surface, so that the unmanned aerial vehicle, for example, can place the postal item into said receptable. The at least one flap can open and close automatically, so that after the postal item has been dropped, the flap again is pivoted or folded up, for instance, in an automatic way, so that the postal item falls into the receiving chamber. For example, the exterior opening and, for example, also the interior opening are designed to be burglar-resistant.

Various electronic components, such as control units and sensors, can be provided to enable autonomous operation of the receiving and pick-up device. For example, a scanner may be provided to read in a package code or the like. It is also possible that a control panel, for instance, a touch display or keypad is provided. In addition, the deliverer or collector can enter a code or the like in order to identify himself or herself as the person authorized to deliver or collect the postal item or to open the exterior opening. The scanner and/or the control panel can be arranged in front of the exterior opening and, thus, being positioned outside receiving chamber. Thus, the receiving and pick-up device can be automated to automatically open the exterior opening whenever the postal item to be inserted has been identified by the scanner or control panel and released for insertion via the control unit, or when the delivery or pick-up authorised person has identified himself. Another electronic component may be a camera that records the insertion and/or removal process of the postal item for evidentiary purposes. A recognition software can also be provided which identifies the postal item images provided by the camera. The camera can also be used to improve burglary protection by detecting whether there is a person or other object inside the receiving chamber other than the identified postal item. A further electronic component can be a scanner located within the receiving chamber to record the size of the postal item or to read the parcel code of the inserted postal item, in particular the QR code or the like. Another electronic component may be a scale in the receiving chamber that weighs the inserted mail. The weight of the postal item can be used to identify the postal item. The signals from the scale can also be used, to register the insertion or removal of the postal item. Another electronic component may be a data interface with a connection to a network, for example to the world wide web, for example to inform the recipient of the postal item of the receipt of the postal item. The carrier can also be informed of the successful delivery of the postal item to the receiving and pick-up device via means of the data link. When picking up a postal item previously inserted in the receiving and pick-up device, the sender and/or the shipper or pick-up person can be informed of the removal of the postal item via the data interface. A further electronic component can be an air conditioning system that conditions the receiving chamber. For example, a received postal item may contain a product to be cooled, for instance a perishable product. Said product could, then, be cooled until manual removal by the recipient. Furthermore, for example, the air conditioning system can heat the receiving chamber. Thus, for example, a food delivery of a hot pizza, for instance, could be held warm within the receiving chamber until it is taken out. Furthermore, the receiving and pick-up device could, as an exception, be blocked from receiving further postal items until the inserted postal item to be air-conditioned has been removed. The air-conditioning system can also air-condition a postal item that has been placed in the receiving chamber for collection until it is removed by the person authorised to collect it.

Furthermore, an arrangement with several receiving and pick-up devices can be provided. For example, in the entrance area of a multi-party house, several of the prescribed receiving and pick-up devices can be grouped together.

A solution to the above-mentioned problem can further be in a method for receiving postal items, for example large-volume postal items such as packages, parcels or the like, whereby the method comprises the following steps according to the invention: providing the aforesaid device, the extension part being arranged in the first position; identifying a postal item located outside the receiving chamber in front of the outer exterior opening; actuating the adjustment device to adjust the volume of the receiving chamber to the size of the identified postal item; unlocking the exterior opening after successful identification of the postal item; checking whether the exterior opening is closed; opening the interior opening, the interior opening being unlocked only when the exterior opening is closed; and actuating the adjustment device to return the extension part back to the first position. The method of receiving postal items according to the invention offers the same advantages as the receiving and pick-up device according to the invention, so that reference is made to the above description.

As the adjustment device returns the extension part back into the first position after each receiving process, the inserted postal item is automatically ejected through the interior opening. In this way, the receiving and pick-up device is again available for a new receiving process again after completion of each receiving process. The next time the postal item is received, the adjustment device adjusts the housing again to adapt the volume of the receiving chamber to the next identified postal item.

If the receiving and pick-up device is positioned at a low level above the stationary ground, for example the corridor of an apartment, the extension part moved by the adjustment device can push away the already received and ejected postal item and thus provides space for the next postal item. In contrast, with an arrangement of the receiving and pick-up device at an higher level over ground, after ejection through the interior opening, the postal item can fall into a container such as a box, basket or the like and be collected there.

A solution to the above-mentioned problem can also be a method for the collection of postal items, for example large-volume postal items such as packages, parcels or the like, whereby the method comprises the following steps according to the invention: providing the described receiving and pick-up device; identifying a collection authorised person located in front of the exterior opening; checking whether the interior opening is closed; unlocking the exterior opening after successful identification of the collection authorised person, the exterior opening being unlocked only if the interior opening is closed; actuating the adjustment device for returning the extension part back to the first position. The method of collecting postal items in accordance with the invention has the same advantages as the receiving and pick-up device in accordance with the invention and the method of receiving postal items in accordance with the invention, so that reference is made to the above description.

In that the receiving and pick-up device is moved back into the first position after the picking up of the postal item placed into the receiving chamber, the receiving and pick-up device is available again for a receiving procedure of postal items immediately after the picking up procedure.

BRIEF DESCRIPTION OF THE DRAWINGS

Preferred examples of the invention are shown in the drawings and described below. In this shows.

DETAILED DESCRIPTION OF THE INVENTION

Figure 1:
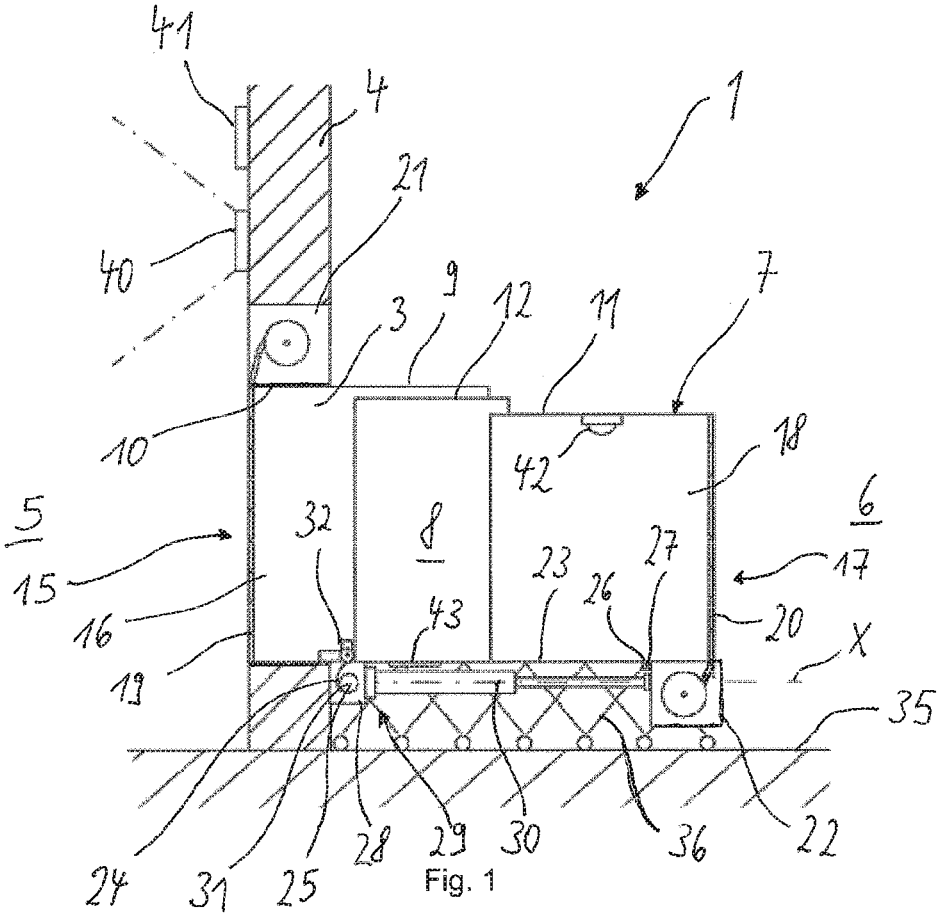
FIG. 1 a sectional view of a receiving and pick-up device in accordance with an embodiment of the present invention, the receiving and pick-up device being in an intermediate position and shown in the installed state.

FIGS. 1 to 19 show a device 1 for receiving and pick-up postal items 2 in accordance with an embodiment of the present invention. The receiving and pick-up device 1 is installed in a passage opening 3 of a building section 4, for example, an exterior wall of an apartment. For example, the receiving and pick-up device 1 could also be installed in another part of a building, such as a front door, apartment door, an exterior wall of a detached house, a basement wall, a window or the like, in a stand-alone housing or on the roof top of a building. The receiving and pick-up device 1 serves, on the one hand, to receive postal items 2 in the absence of the recipient. A carrier can insert the postal delivery 2 into the receiving and pick-up device 1 from an outside space 5, i.e. an area outside a living space 6. The receiving and pick-up device 1 can receive a plurality of postal items 2 one after the other in the absence of the recipient, i.e. without the recipient being involved, as described below. Furthermore, a sender, for example the owner of the receiving and pick-up device 1, can insert a postal item 2 into the receiving and pick-up device 1, which can be removed at a later time by a collector from the outside space 5. After the postal item 2 has been picked up by the collector, the receiving and pick-up device 1 is ready to receive postal items 2 without any action of the sender.

FIG. 1 shows the receiving and pick-up device 1 in sectional view. The receiving and pick-up device 1 has a multi-part housing 7, which encloses a receiving chamber 8 for receiving postal items 2. The housing 7 is box-shaped and can be adjusted telescopically along an adjustment axis X to increase or decrease the volume of the receiving chamber 8. In this way, the volume of the receiving chamber 8 can be adapted to the size of the postal item 2. The housing 7 has a base part 9 which is fixed to the building part 4. The base part 9 has a mounting frame 10 which is inserted in the passage opening 3 and connected to the building part 4, e.g.

screwed. Furthermore, the housing 7 has an extension part 11, which is adjustably arranged in the adjustment axis X relative to the fixed base part 9. In addition, the housing 7, by way of an example, has an optional intermediate part 12, which is arranged between the base part 9 and the extension part 11 to increase the maximum volume of the receiving chamber 8. The intermediate part 12 is adjustable between base part 9 and extension part 11 along the adjustment axis X relative to base part 9. To further increase the maximum volume available, further intermediate parts 12 could also be provided. In a simple embodiment not shown, the housing 7 can only have the base part 9 and the extension part 11, but no intermediate part 12.

Figure 2:
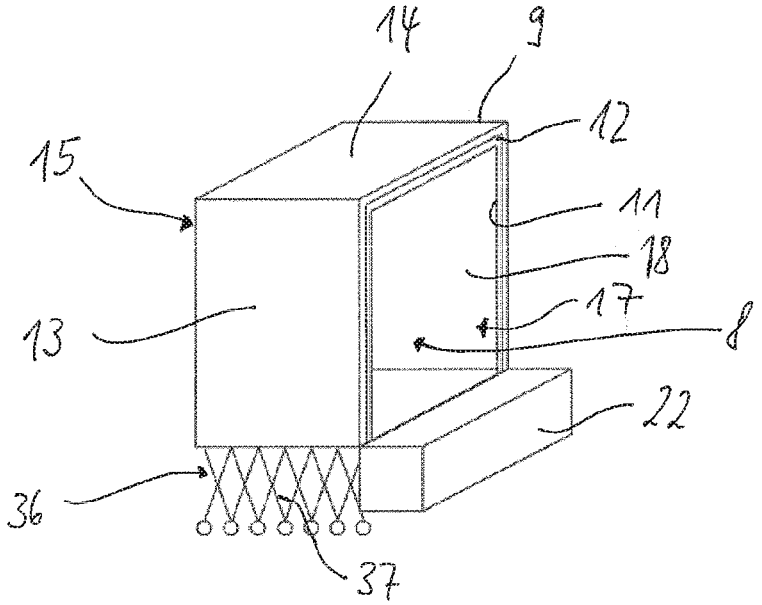
FIG. 2 the receiving and pick-up device in a first position in perspective side view.
Figure 3:
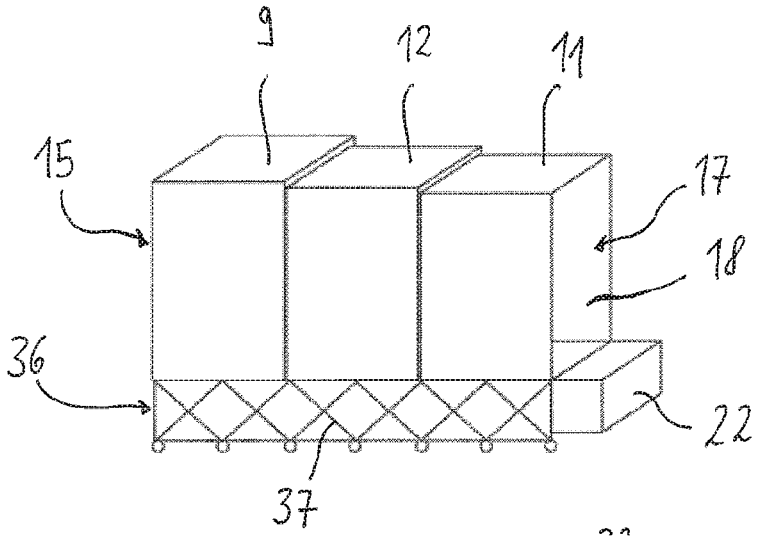
FIG. 3 the receiving and pick-up device in a second position of perspective side view.

FIG. 2 shows the receiving and pick-up device 1 in simplified form. The receiving and pick-up device 1 is in a first position in which the extension part 11 and the intermediate part 12 are telescopically retracted into the base part 9. In the first position, the receiving chamber 8 has a minimum volume, also known as the first volume. In contrast, the receiving and pick-up device 1 in FIG. 1 is shown in an intermediate position in which the recording space 8 has a volume enlarged relative to the first volume. FIG. 3 shows the receiving and pick-up device 1 in a second position in which the housing 7 is extended to its maximum. In the second position, the receiving chamber 8 has a maximum volume, which is also referred to as the second volume.

The housing parts, namely base part 9, extension part 11 and optional intermediate part 12 are U-shaped and each have two opposing outer walls 13 and a ceiling 14, which delimit the receiving chamber 8 laterally and upwards, respectively. On a first front face 15 of the base part 9, which is directed towards the outside space 5, a closable exterior space opening 16 is arranged, which separates the receiving chamber 8 from the outside space 5. A lockable interior opening 18 is arranged on a second front face 17 of the extension part 11 opposite the first front face 15 in the direction of the adjustment axis X. Both, the exterior opening 16 and the interior opening 18, are equipped with an exterior roller shutter 19 and an interior roller shutter 20, respectively. The exterior roller shutter 19 is guided in a roller shutter box 21, which is positioned by way of, here an example, above the base part 9 in building part 4. The interior roller shutter 20 is guided in a roller shutter box 22, which, here by way of an example, is arranged underneath the extension part 11, fixed to the extension part 11. Furthermore, the receiving and pick-up device 1 may have a slot for a letter (not shown) the slot could be arranged in the exterior opening 16, for instance.

Figure 20:
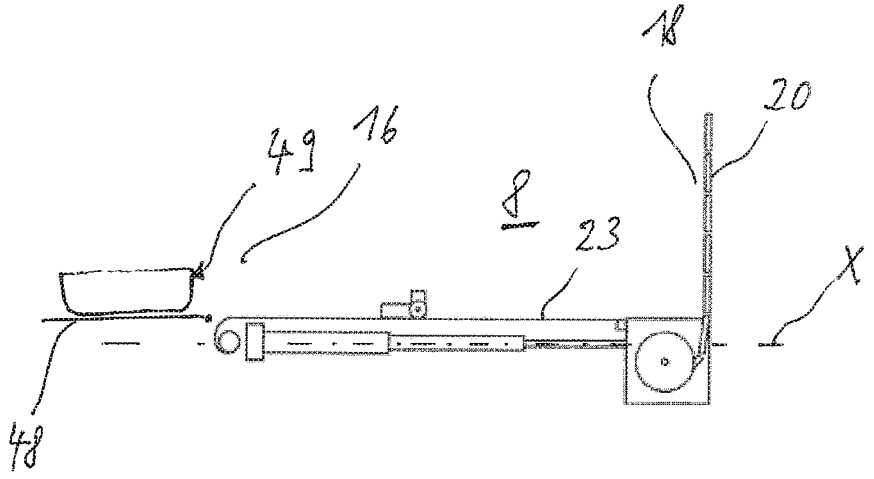
FIG. 20 the receiving and pick-up device of FIG. 1 having an alternative closing for the exterior opening.

For example, the exterior opening 16 and the interior opening 18 can also have alternative devices for closing and opening. FIG. 20 shows as a further example for the exterior opening that can be closed with a flap 48, which can be pivoted about a pivot axis S, e.g. arranged on building part 4 or on the receiving and pick-up device 1, e.g. the installation frame 10 or the base part 9. The pivot axis S is arranged horizontally so that the flap 48 can be opened downwards. When open, the flap 48 can enclose an angle of approximately +/−20 degrees with the adjustment axis X, whereby the flap 48 is preferably aligned at least approximately horizontally and, for example, is arranged parallel to the adjustment axis X. A receptable 49 is arranged on the inside of flap 48 facing towards receiving chamber 8 when the flap 48 is closed.

FIG. 1 shows that the housing 7 ends at the bottom with a deposit band 23, which limits the bottom side of the receiving chamber 8. The deposit band 23 is finitely designed, whereby a first end 24 of the deposit band 23 is connected to a winding drum 25 so that it can be rolled up, and a second end 26 of the deposit band 23 is connected to a holder 27 space from the winding drum 25. The holder 27 is fixed relative to the extension part 11. FIG. 1 shows that the holder 27 is attached to the interior roller shutter box 22. Whereas the winding drum 25 is rotatably mounted in a drum box 28, which is held stationary relative to the base part 8. For example, the drum box 28 can be attached to building part 4 or base part 9. Both, the winding drum 25 and the holder 27, are aligned transversely to the adjustment axis X.

Furthermore, the automated adjustment of the housing 7 is explained, which allows a stepless adjustment of the volume of the receiving chamber 8 along the adjustment axis X between the first position and the second position.

An adjustment device 29 is provided for this purpose. The adjustment device 29 has a variable-length actuator 30 acting along the adjustment axis X. Said actuator 30 is located outside the receiving chamber 8, here, below the deposit band 23. The actuator 30 is fixed at a first longitudinal end facing the building part 4 relative to the base part 9 and is supported at a second longitudinal end facing away from the building part 4 by the extension part 11. FIG. 1 shows, by way of example, that the first longitudinal end of actuator 30 is attached to the drum box 28 and that the second longitudinal end of actuator 30 is supported by the interior roller shutter box 22.

In the first position of the extension 11 shown in FIGS. 2, 10, 16 and 19, the actuator 30 is fully retracted, whereas the actuator 30 is fully extended in the second position shown in FIGS. 3, 12, 13, 17 and 18. Starting from the first position, the actuator 30 pushes the extension part 11 connected to the interior roller shutter box 22 along the adjustment axis X to the second position when actuating the actuator 30. As soon as the extension part 11 is moved from the intermediate position shown in FIG. 1 to the second position, the extension part 11 pulls the intermediate part 12 along with it. When the extension part 11 is moved to the second position, the deposit band 23, which is connected to the holder 27, is unwound from the winding drum 25 so that the length of the bottom of the receiving chamber 8 delimited by the deposit band 23 is extended correspondingly with the extension of the housing 7.

In order to move the extension part 11 back into the first position, the adjustment device 29 comprises the winding drum 25 and a drive motor 31, for example an electric motor, which rotationally drives the winding drum 25. When the drive motor 31 is actuated, the deposit band 23 is at least partially wound or rolled onto the winding drum 25. As a result, the deposit band 23, which is connected to the extension part 11 via the holder 27, pulls the extension part 11 back into the first position. The actuator 30 can be depressurized or pulled in against a slight counter-pressure to prevent the deposit band 23 from sagging. However, the actuator 30 could also be actively retracted in order to offload the deposit band 23 and to support the return of the extension part 11 to the first position. At least for the latter, the second longitudinal end of the actuator 30 can be fixed to the inner roller shutter 22. The deposit band 23 can, for example, always be kept under tension in order to avoid sagging of the deposit band 23.

Figure 4:
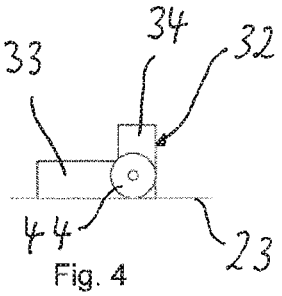
FIG. 4 an enlarged partial view of the receiving and pick-up device with an end stop in folded position.
Figure 5:
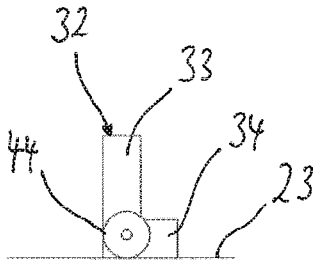
FIG. 5 the end stop from FIG. 4 in upright position.

Furthermore, an end stop 32 is arranged transversely to the adjustment axis X in the receiving chamber 8. When the extension part 11 is returned to its first position, the end stop 32 prevents a postal item 2 inserted in the receiving chamber 8 from being moved beyond the end stop 32 in the direction of the exterior opening 16 when winding the deposit band 23. In this way, when the interior opening 18 is opened and the extension part 11 is returned to the first position, the inserted postal item 2 can fall out of the receiving chamber 8 through the interior opening 18 into the living space 6. FIGS. 1, 4 and 5 show that the end stop 32 is L-shaped and extends over the width of the deposit band 23, for example, over the entire width of the deposit band 23. The end stop 32 is fixed to the housing 7. Furthermore, the end stop 32 is rotatably mounted and transversely arranged to the adjustment axis X to rotate the end stop 32 into a folded down or tilted position, which is shown in detail in FIG. 4, and an erected position, which is shown in detail in FIG. 5. For this purpose, along a connection between a long L-leg 33 and a short L-web 34 of the end stop 32, a wheel 44, e.g. a plastic wheel, is provided, which is connected to the deposit band 23 with a friction-lock. When the deposit band 23 is wounded, the L-leg 33 flips over. Since the deposit band 23 is usually wound at least partially before the postal item 2 is inserted into the receiving chamber 8 in order to adjust the volume of the receiving chamber 8 to the size of the postal item 2, the end stop 32 is in the tilted position shown in FIG. 4 when the postal item 2 is inserted. This means that the longer L-leg 33 does not stand in the way when inserting or removing the postal item 2. It should be noted, however, that even the first position may already provided a sufficiently large first volume to insert small-volume postal items 2. When the deposit band 23 is wound, as shown in FIG. 5, the end stop 32 is turned to the upright position. In the upright position, the long L-leg 33 of the end stop 32 is positioned transversely to the deposit band 23 and offers a larger stop surface on which the postal item 2 can rest when the deposit band 23 is wound. Basically, it is also possible to fix the end stop 32 mirror-inverted to the arrangement shown in FIGS. 1, 4 and 5 on the housing 7, so that the short L-bar 34 does not face the interior opening 18, as shown here, but the exterior opening 16. Instead of rotating it, it is also possible to non-rotatably hold the end stop 32 at the base part 9. At least in the latter, the end stop 32 may have shape alternative to the L-shape, for example the end stop could have the form of a rod extending across the deposit band 23.

Figure 6:
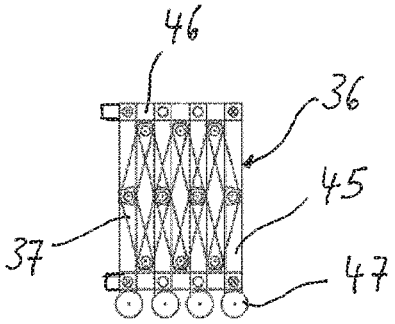
FIG. 6 an enlarged partial view of the receiving and pick-up device with alternative supports in the first position.
Figure 7:
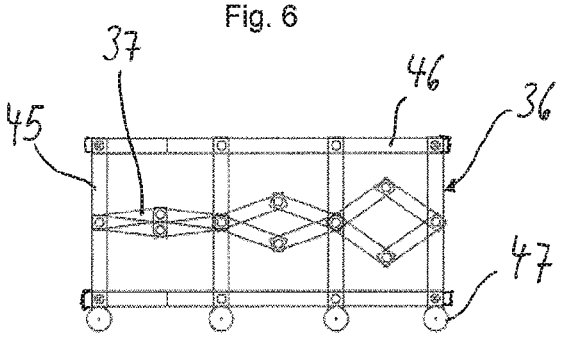
FIG. 7 the supports from FIG. 6 in the second position.
Figure 8:
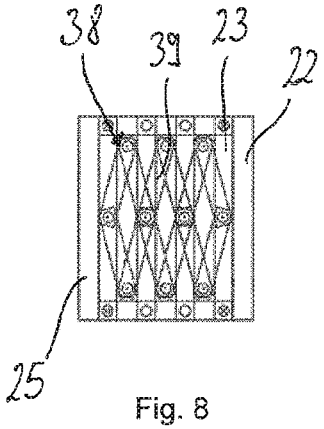
FIG. 8 a partial view of the receiving and pick-up device with a band enforcement in the first position.
Figure 9:
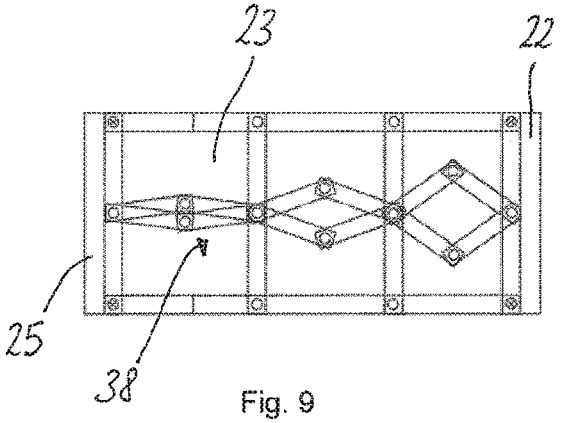
FIG. 9 the tape reinforcement from FIG. 8 in the second position.

FIG. 1 shows that the receiving and pick-up device 1 is arranged close to at a low elevation above a stationary ground 35, for example the corridor floor of the living space 6. Close to the fixed ground 35 means that the upper edge of the deposit band 23 is about 20 cm to 60 cm above the ground 35. This ensures that the received postal item 2 is not damaged when it falls out through the interior opening 18 due to the low drop height. In principle, the receiving and pick-up device 1 can also be used in a recess, a trough or the like, which is formed in the stationary ground, for example. The upper edge of the deposit band 23 can, then, be flush with the stationary ground 35 to push the postal item 2 out of the receiving chamber 8 at ground level. Supports 36 may be provided to support the housing 7 against the ground 35. Supports 36 are shown in FIG. 3 in an extended position. FIGS. 6 and 7 show, in detail, an alternative configuration of the supports 36, the supports 36 being arranged in FIG. 6 in the first position and in FIG. 7 in the second position or extended position. The supports 36 have a plurality of articulated struts 37, which are held rotatably on cross struts 45. The ends of the cross struts 45 are each guided on a longitudinal rail 46, which extends along the adjustment axis X. The ends of the cross struts 45 are each guided on a longitudinal rail 46, which extends along the adjustment axis X. At the end of the cross struts 45 facing the ground 35, wheels 47 are rotatably mounted on the struts 37 so that the supporting means 36 can be moved on the ground 35 when the adjustment device 29 is actuated. The longitudinal end of the supports 36, shown in FIGS. 6 and 7 on the left, may be fixed relative to base part 9. For example, the longitudinal end of supports 36, shown on the left, may be attached to building part 4, drum box 28 or base part 9. The longitudinal end of the support means 36, shown in FIGS. 6 and 7 on the right, may be fixed relative to the extension part 11, for example on the inner roller shutter box 22 or the extension part 11. In this way, the articulated struts 37 are pushed together in the first position, as shown in FIG. 6, and pulled apart in the second position, as shown in FIG. 7. However, for example, the receiving and pick-up device 1 can also be arranged at a higher level above the ground 35. If necessary and desired, suitable precautions can then be taken to avoid damage to the received postal item 2 when it falls out. For example, a basket or the like may be provided into which the postal item 2 could fall after ejection through the interior opening 16. With a higher arrangement of the receiving and pick-up device 1 in the living space 6, supports 36 could also be forgo.

In order to avoid sagging of the deposit band 23, as far as possible during operation of the receiving and pick-up device 1, especially, when inserting the postal item 2, a belt reinforcement 38 can be provided below the deposit band 23. The optional band reinforcement 38 is shown in detail in FIGS. 8 and 9. The band reinforcement 38 has several movably connected reinforcing elements 39 which are superposed or folded in the first position of extension part 11 shown in FIG. 8 and pulled apart in the second position of extension part 11 shown in FIG. 9.

In order to enable autonomous operation of the receiving and pick-up device 1, various electronic components are also provided, which will be discussed in more detail below. A control unit (not shown) is connected to other electronic components and controls the adjustment device 29 as well as the exterior roller shutter 19 and the interior roller shutter 20. A scanner 40 is arranged on one side of the building part 4 facing the outside space 5 and is connected to the control unit. Using the scanner 40, the deliverer can, for example, scan in a parcel code from the postal item 2. Furthermore, a control panel 41, for example a touchpad or a keypad, is arranged on the outside of the building part 4 facing the outside space 5, via which the deliverer can enter a code or the like in order to enter a mailing code of the postal item 2, an authentication code of the deliverer or the like. For example, a code may also be provided so that, for example, the owner of the receiving and pick-up device 2 can always open the exterior opening 16, for example for maintenance purposes. Furthermore, a camera 42 is arranged within the receiving chamber 8. In addition, a scale 43 is provided on the floor side, which can weigh the weight of the postal item 2 placed on the deposit band 23.

FIGS. 10 to 16 show, by way of example, several steps of the method for receiving postal items 2 in chronological order, which will be discussed in more detail below.

Figure 10:
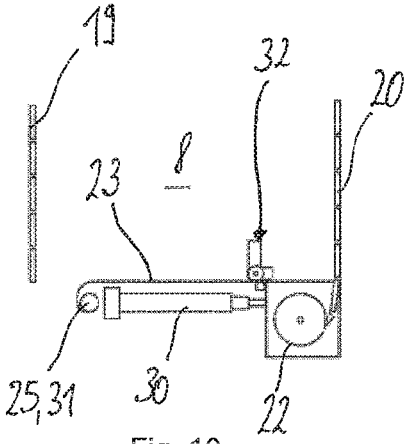
FIG. 10 the receiving and pick-up device in said first position prior to receiving a postal item in simplified schematic side view.

In the first position, shown in FIG. 10, the volume of the receiving chamber 8 is at its minimum. In principle, the receiving and pick-up device 1 is already suitable in the first position for receiving a small-volume postal item 2. The carrier scans the parcel code using the scanner 40. Alternatively or additionally, he can authenticate himself via the control panel 41 or enter the package code via said control panel 41. The control unit checks the data collected by the scanner 40 or entered in the control panel 41 to identify the postal item 2 located outside the receiving chamber 8 in front of the exterior opening 16. For this purpose, the control unit may have a connection to the world wide web. Then, when a product is purchased online, the online seller usually transmits a tracking number to the buyer digitally after the product has been shipped in order to track the mailing. The control unit may use such tracking numbers or other identification codes provided by the seller to verify the postal item 2 scanned in by the carrier in front of the exterior opening 16 or the code entered by the carrier via the control panel 41. The scanned parcel code, tracking number or the like usually include information about the size, weight, etc. of the postal item 2, which could be used to adapt the volume of the receiving chamber 8 or to identify the postal item 2. If this is not the case, the carrier can enter further information about the postal item 2, such as the weight or volume of the postal item 2 to be inserted, via the control panel 41.

Figure 11:
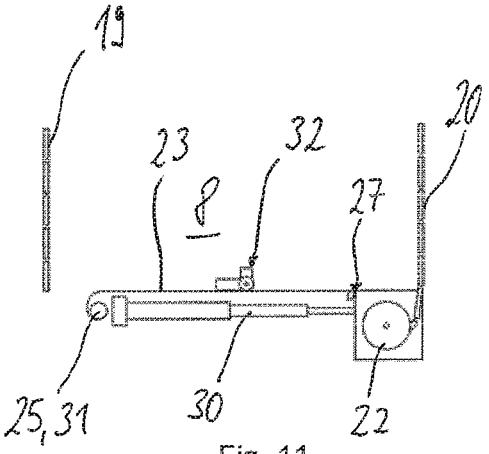
FIG. 11 the receiving and pick-up device in the intermediate position before receiving a postal item in simplified schematic side view.
Figure 12:
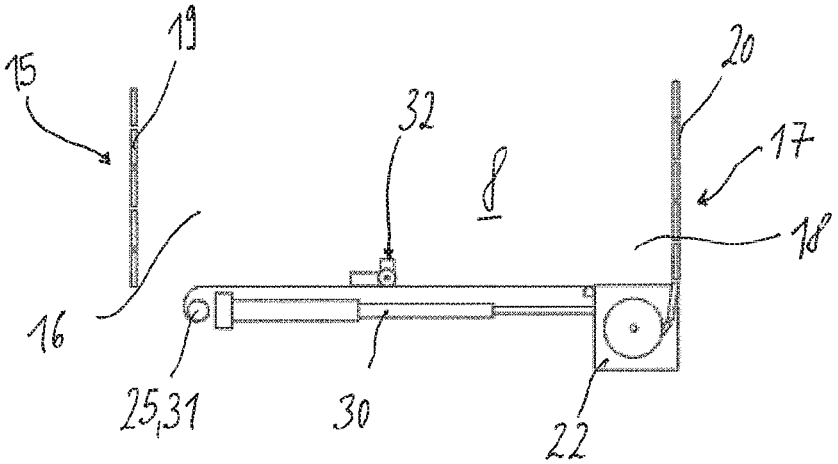
FIG. 12 the receiving and pick-up device in the second position before receiving a postal item in simplified schematic side view.

After successful identification of the postal item 2 to be inserted, the control unit controls the adjustment device 29. If the first volume of the receiving chamber 8 in the first position, shown in FIG. 10, is already sufficient to accommodate the identified postal item 2, the control unit unlocks the exterior opening 16 and the exterior roller shutter 19 is opened without any volume adjustment to be made with respect to the first position. When the volume of the identified postal item 2 is larger than the first volume of the receiving chamber 8, the control unit controls the adjustment device 29 to adjust the volume of the receiving chamber 8. In order to adjust the volume of the receiving space 8, the variable-length actuator 30 extends and presses against the inner roller shutter box 22, whereby the extension part 11 is continuously extended along the adjustment axis X into intermediate positions and, depending on the size of the identified postal item 2 even, further into the second position according to FIG. 12. FIG. 11 shows such an intermediate position with which a larger volume of the receiving chamber 8 can be provided in relation to the first volume. During the extension movement of the actuator 30, the deposit band 23 is pulled by the extension part 11 and unwinds at least partially from the winding drum 25. Due to the unwinding of the deposit band 23, the end stop 32 turns from the erected position, shown in FIG. 10, to a tilted position shown in FIGS. 11 and 12.

Figure 13:
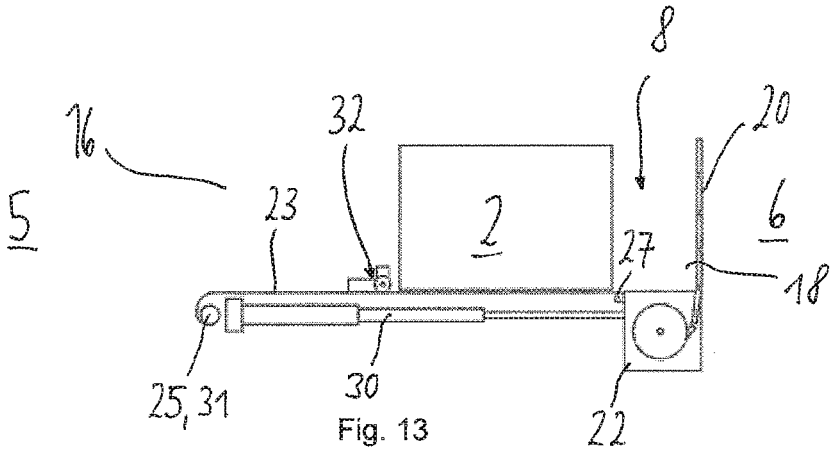
FIG. 13 the receiving and pick-up device in the second position in simplified schematic side view, wherein the postal item is inserted.

After the adjustment device 29 has adapted the volume of the receiving chamber 8 to the postal item 2 to be inserted, the control unit unlocks the exterior opening 16 and opens the exterior roller shutter 19. FIG. 13 shows that the postal item 2 can now be inserted into the receiving chamber 8 and placed onto the deposit band 23. Then, either the deliverer can automatically close the exterior opening 16 via the control panel 41, or the control unit can actuate the exterior roller shutter 19. The control unit can, for example, automatically close the exterior opening 16 after the insertion of the postal item 2 has been registered with the 43 scale. Furthermore, a light barrier (not shown) arranged in the area of the exterior opening 16 could check the obstacle clearance, first, before the exterior roller shutter 19 is operated. Alternatively or in addition, a pressure sensor can be integrated into an end rail of the exterior roller shutter 19 in order to partially raise the exterior roller shutter 19 again when hitting an obstacle. Furthermore, the insertion of the postal item 2 can also be registered with the camera 42. In addition, the camera 42 can be used to record the insertion of postal item 2 for evidence purposes.

Figure 14:
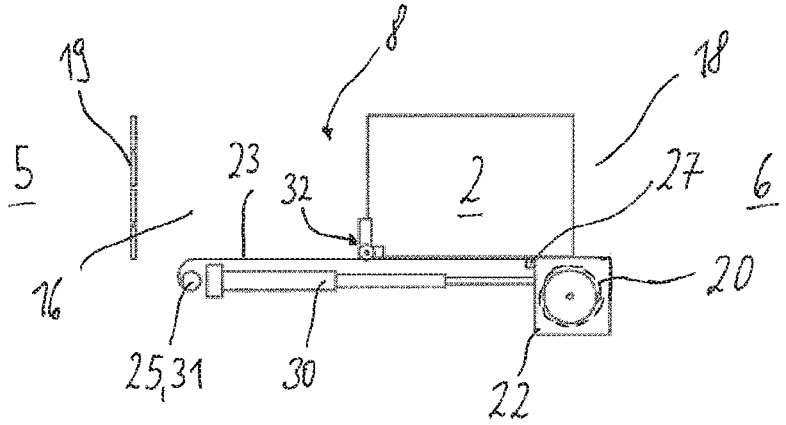
FIG. 14 the reception and pick-up device in an intermediate position after receipt of the postal item in a simplified schematic side view.

In addition, the control unit checks whether the exterior opening 16 is closed. If this is the case, the interior opening 18 is opened, as shown in FIG. 14. For safety reasons, before opening the interior opening 18, the camera 42 can be used, for example, to check the receiving chamber 8 whether there is a person or object other than the postal item 2 in it. To prevent an attempted burglary, the interior opening 18 would then remain closed.

As soon as the interior opening 18 is opened or the interior roller shutter 20 is retracted, the control unit controls the adjustment device 29. In this case, the deposit band 23 is at least partially wound onto the winding drum 25 by actuating the drive motor 31. FIG. 14 shows that, when the deposit band 23 is pulled in, the extension part 11, which is connected to the second end 26 of the deposit band 23 by the holder 27, is moved from the second position, shown in FIG. 13, to the first position, shown in FIG. 15, via the intermediate position, shown in FIG. 14. By this, the interior opening 18 is moved in the direction of the exterior opening 16, thereby reducing the volume of the receiving chamber 8. Furthermore, due to the retraction movement of the deposit band 23, the end stop 32, which interacts frictionally with the deposit band 23, is set up in the erected position, shown in FIG. 14. As a result, the end stop 32 provides a large stop surface for the inserted postal item 2 thereby preventing the postal item 2 from being moved beyond the end stop 32 in the direction of the exterior opening 16 when the deposit band 23 is wounded.

Figure 15:
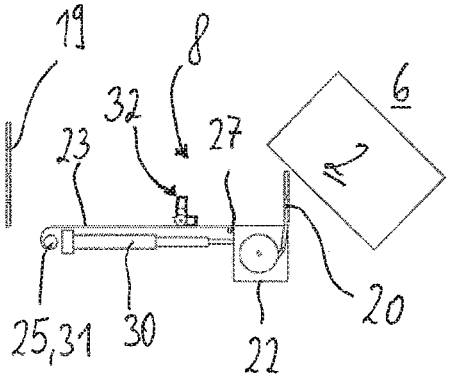
FIG. 15 the receiving and pick-up device in a further intermediate position after receipt of the postal item in a simplified schematic side view.
Figure 16:
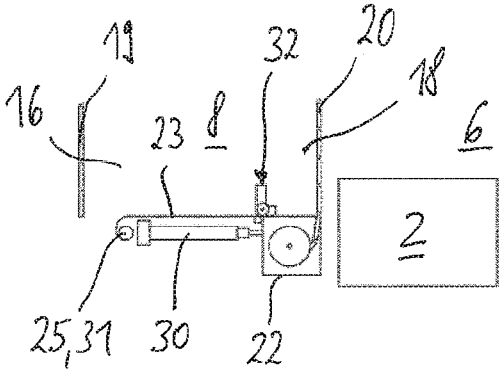
FIG. 16 the receiving and pick-up device in the first position after receipt of the postal item in simplified schematic side view.

As the inserted postal item 2 is held back by the end stop 32, the postal item 2, as shown in FIG. 15, finally falls out of the receiving space 8 through the open interior opening 18 when the receiving and pick-up device 1 is moved back into the first position. While the postal item 2 is pushed out of the interior opening 18, the interior roller shutter 20 can be slightly raised to support the ejection of the postal item 2, as shown in FIG. 15. In principle, however, the postal item 2 also falls out without the support of the raising interior roller shutter 20, so that the interior roller shutter 20 can alternatively be a shutter that moves from top to bottom or a hinged door or the like could be used instead of the shutter 20. As soon as the control unit detects, for example, via the scale 43 or the camera 42, that the postal item 2 has fallen out of the receiving chamber 8, the interior opening 18 is closed by closing the interior roller shutter 20. In the first position shown in FIG. 16, the receiving and pick-up device 1 is then ready to receive further postal items 2.

Finally, the control unit can use the data link to inform both, the sender and the recipient, of the successful delivery or receipt of postal item 2.

When a further postal item 2 is due to be received the volume of the receiving chamber 8 is adjusted to the volume of the next postal item 2, whereby the already received postal item 2 is pushed further into the living space 6 by the side of the receiving and pick-up device facing away from building part 4. By this room is cleared in the living space 6 for the next postal item 2, which can, then, also fall out of the interior opening 16 into the living space 6 just like the first postal item 2. This process can be repeated as often as desired as long as the living space 6 around the receiving and pick-up device 1 offers sufficient room.

Figure 17:
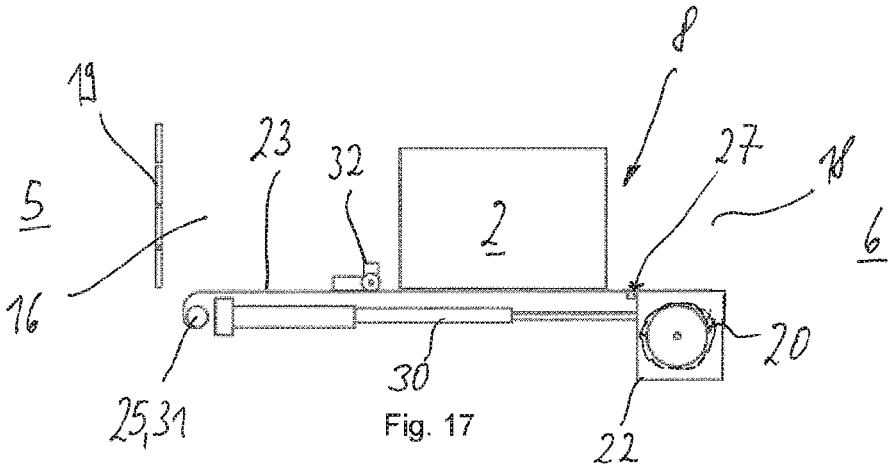
FIG. 17 the receiving and pick-up device in the second position after insertion of a postal item intended for collection in simplified schematic side view.
Figure 18:
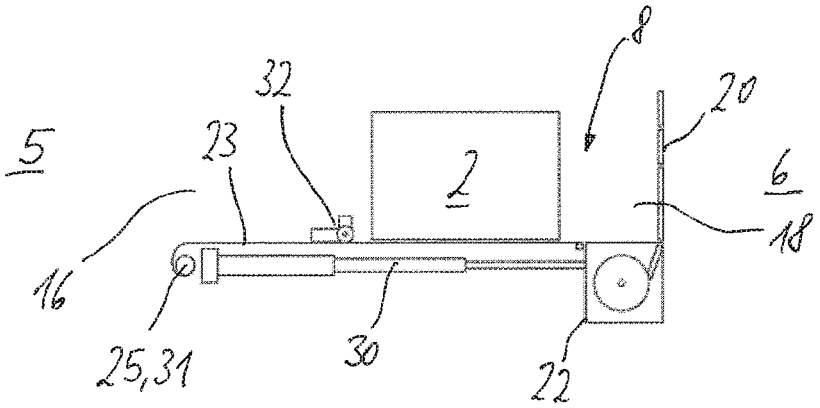
FIG. 18 the receiving and pick-up device in the second position when collecting the postal item in simplified schematic side view.
Figure 19:
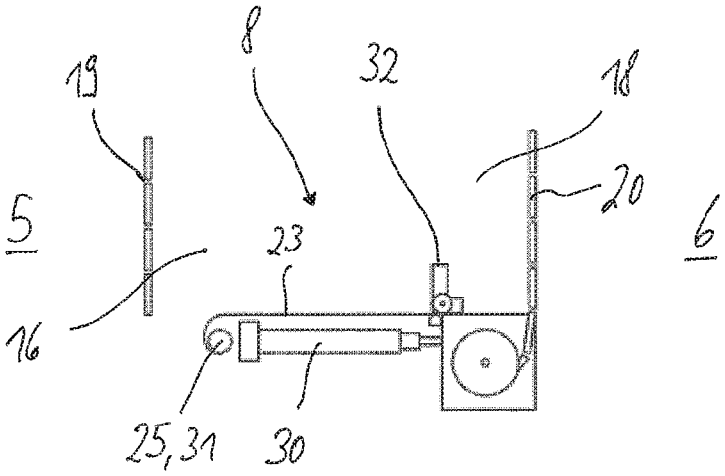
FIG. 19 the receiving and pick-up device in the first position after collecting a postal item in simplified schematic side view.

FIGS. 17 to 19 show, by way of example, several steps of the method for picking up postal items 2 in chronological order, which will be discussed in more detail below.

The sender places the postal item 2 to be collected in the receiving chamber 8. The postal item 2 to be collected can be inserted either through the exterior opening 16 or through the interior opening 18. According to FIG. 17, the postal item 2 to be collected is placed into the receiving chamber 8 via the interior opening 18. In order to adjust the volume of the receiving chamber 8 to the postal item 2 to be collected, the shipper can operate the adjustment device 29 via an additional control panel (not shown) and which can be arranged in the living space 6, or via the outside panel 41. Similarly, a scanner can be provided in the living space 6 to scan the parcel code of the postal item 2 to be collected in order to automatically adjust the volume of the receiving chamber 8 in analogy to the method described above for receiving the postal items. Besides, the package code can also be scanned with the scanner 40 in the outdoor space 5. After the postal item 2 to be collected has been placed on the deposit band 23, the control unit can either close the interior roller shutter 20 upon request of the sender or, as described above, automatically.

If a collection authorised person has identified himself in front of the closed exterior opening 16, for example by scanning a collection slip with the scanner 40 or by entering an authentication code via the control panel 41, the control unit checks whether the interior opening 18 is closed. If the interior opening 18 is still open, it may be the case that the exterior opening 16 is not unlocked though the person authorised to collect has run the identification successfully. When the interior opening 16 is closed, the exterior opening 16 is unlocked. Then, the exterior opening 16 can be opened either manually by the authorised collector or automatically by opening the exterior roller shutter 19. After, the person authorised to collect can remove the inserted postal item 2.

As soon as the postal item 2 to be picked up has been removed from the receiving chamber 8, the exterior opening 16 can be closed either manually by the collector or automatically by the control unit by closing the exterior roller shutter 19. Furthermore, the control unit controls the adjustment device 29 so that it moves the extension part 11, if it was not in the first position, back to the first position. The receiving and pick-up device 1 is again ready to receive further postal items 2.

Figure 21:
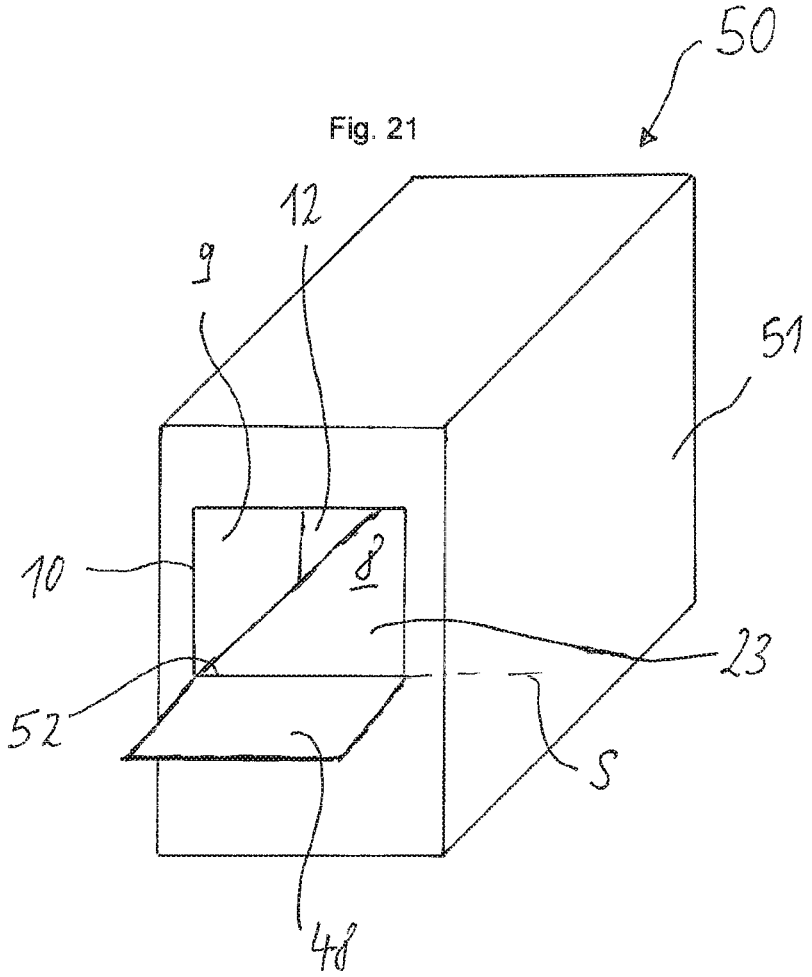
FIG. 21 a perspective view of a receiving and pick-up device in accordance with a further embodiment of the present invention in an intermediate position, wherein the receiving and pick-up device is installed in a stand-alone housing.

FIG. 21 shows a receiving and pick-up device 50 for postal items 2 according to a further embodiment of the present invention. Components which conform to components of the embodiments described in FIGS. 1 to 19 are marked with the same reference signs. The device 50, as shown in FIG. 20, differs from the previous embodiments only in that the receiving and pick-up device 50 is housed in a weatherproof housing 51. The reception and collection device 50 is, thus, designed as a stand-alone mailbox, which can, for example, be installed outside a building, especially in front of the building, or on the roof top of a building.

For this purpose, the base part 9 of the housing 7 is fixed to the stand-alone housing 51. The base part 9 has a mounting frame 10, which is inserted in the passage opening 52 of the stand-alone housing 51 and connected to the stand-alone housing 51, e.g. screwed. The exterior opening 16 can be closed by the flap 28, which is held around the horizontal pivot axis S, analogous to the embodiment shown in FIG. 20. The interior opening (not shown) is located inside the stand-alone housing 51. Here, a lockable and removable opening is provided on a back side or lateral side of the stand-alone housing 51 through which the postal item can be removed. For example, the postal item ejected from the interior opening may fall onto the bottom floor of the stand-alone housing 51 or into a collection container within the stand-alone housing 51, so that the postal item 2 can later be removed from the stand-alone housing 51 by the recipient.

The invention claimed is:

1. A receiving and pick-up device for postal items, having a housing comprising a receiving chamber and comprising a base part and an extension part, which is arranged adjustably relative to the base part along an adjustment axis, wherein a closable exterior opening is formed on a first front face of the base part and a closable interior opening is formed on a second front face of the extension part being opposite the first front face in the direction of the adjustment axis, and having an adjustment device, which is designed for adjustment of the volume of the receiving chamber such that the extension part can be adjusted along the adjustment axis between a first position, in which the receiving chamber has a first volume, and a second position, in which the receiving chamber has a second volume enlarged relative to the first volume, and having a deposit band delimiting the receiving chamber at its bottom, wherein the deposit band has a finite length, and the adjustment device has a rotatably mounted winding drum, wherein a first end of the deposit band is connected to the winding drum such that it can be rolled up, and a second end of the deposit band is fixed to a holder spaced apart from the winding drum.

2. The receiving and pick-up device according to claim 1, wherein the winding drum is held stationary relative to the base part, and the holder is arranged at the extension part, so that the distance between the winding drum and the holder can be reduced by winding the deposit band onto the winding drum.

3. The receiving and pick-up device according to claim 1, wherein the winding drum can be driven in rotation by a drive motor.

4. The receiving and pick-up device according to claim 1, wherein the adjustment device has a variable length actuator acting along the adjustment axis, a first longitudinal end of the actuator is held stationary relative to the base part and a second longitudinal end of the actuator is supported by the extension part.

5. The receiving and pick-up device according to claim 1, wherein the housing is of box-shaped design, the base part and the extension part each having at least two opposing outer walls and each having a cover, so that the housing can be adjusted telescopically along the adjustment axis.

6. The receiving and pick-up device according to claim 1, wherein an end stop is arranged within the receiving chamber and transversely to the adjustment axis, the end stop being mounted non-rotatably or rotatably to the housing.

7. The receiving and pick-up device according to claim 6, wherein the rotatably mounted end stop is L-shaped and is connected to the deposit band with a friction-lock such that, when the deposit band is wound onto the winding drum, the end stop is rotated into an upright position, in which a long L-leg of the end stop is set up crosswise to the deposit band.

8. The receiving and pick-up device according to claim 1, wherein a band reinforcement is arranged below the deposit band, the band reinforcement having at least two movably interconnected reinforcing elements, which are folded or superposed in the first position of the extension part and are pulled apart in the second position of the extension part.

9. The receiving and pick-up device according to claim 1, wherein supports are provided and designed such that the housing can be supported on a stationary ground.

10. The receiving and pick-up device according to claim 1, wherein the exterior opening and/or the interior opening each are/is lockable by a roller shutter.

11. The receiving and pick-up device according to claim 1, wherein the exterior opening and/or the interior opening each are/is lockable by a flap being held pivotably about a pivot axis.

12. The receiving and pick-up device according to claim 11, wherein the pivot axis is arranged horizontally.

13. The receiving and pick-up device according to claim 11, wherein a receptacle is provided on the flap closing the exterior opening, the receptacle being arranged on an inner side of the flap facing the receiving chamber.

14. The receiving and pick-up device according to claim 1, wherein the base part has an installation frame for insertion in an passage opening of a part of a building or an aperture of a stand-alone housing.

15. A method for receiving postal items using the receiving and pick-up device according to claim 1, comprising the following steps:

providing the receiving and pick-up device, the extension part being arranged in the first position;

identifying a postal item located outside the receiving chamber and located in front of the exterior opening;

actuating the adjustment means to adjust the extension part into the second position in order to adjust the volume of the receiving chamber to the size of the identified postal item;

unlocking the exterior opening after successful identification of the postal item;

checking whether said exterior opening is closed;

unlocking the interior opening only when said exterior opening is closed;

opening said interior opening, and actuating the adjustment device to adjust the extension part back into the first position.

16. A method for collecting postal items using the receiving and pick-up device according to claim 1, comprising the following steps:

providing the receiving and pick-up device;

identifying an authorised recipient located in front of the exterior opening;

checking whether the interior opening is closed;

unlocking of the exterior opening after successful identification of the authorized recipient, the exterior opening only being unlocked if the interior opening is closed;

actuating the adjustment device to adjust the extension part into the first position.

* * * * *